US005192123A

United States Patent [19]

Wallin

[11] Patent Number: 5,192,123

[45] Date of Patent: Mar. 9, 1993

[54] FLOOR ANCHOR FOR A CABINET

[75] Inventor: Robert M. Wallin, Aurora, Ill.

[73] Assignee: Aurora Equipment Co., d/b/a Equipto, Aurora, Ill.

[21] Appl. No.: 610,381

[22] Filed: Nov. 5, 1990

[51] Int. Cl.[5] ..... A47B 96/00

[52] U.S. Cl. ..... 312/351.7; 248/500; 248/680

[58] Field of Search ..... 248/680, 672, 500, 499, 248/300, 510, 505, 503, 551, 346, 681; 312/253

[56] References Cited

U.S. PATENT DOCUMENTS

| | | | |
|---|---|---|---|
| 53,415 | 3/1886 | Cole . | |
| 271,263 | 1/1883 | Phillips . | |
| 326,470 | 9/1885 | Young . | |
| 670,763 | 3/1901 | Brodeur . | |
| 989,085 | 4/1911 | Turton | 248/680 |
| 1,450,183 | 4/1923 | Moon . | |
| 1,481,396 | 1/1924 | Ternes | 248/680 |
| 1,508,326 | 9/1924 | Hensley et al. . | |
| 1,551,516 | 8/1925 | McGovern . | |
| 1,823,753 | 8/1931 | Muhlfeld . | |
| 2,153,679 | 4/1939 | Rich . | |
| 2,266,852 | 12/1941 | Cunningham . | |
| 3,324,524 | 6/1967 | Perron et al. | 248/346 X |
| 3,388,885 | 6/1968 | Holmes | 248/500 X |
| 3,392,954 | 7/1968 | Malitte . | |
| 3,429,543 | 2/1969 | Mooney | 248/346 |
| 3,664,628 | 5/1972 | Noble . | |
| 4,249,684 | 2/1981 | Miller et al. | 248/551 X |
| 4,474,387 | 10/1984 | Maranell et al. | 248/346 X |
| 4,607,990 | 8/1986 | Eggers | 248/499 X |
| 4,669,695 | 6/1987 | Chou . | |
| 4,754,948 | 7/1988 | Casciani | 248/500 |
| 4,890,813 | 1/1990 | Johnson et al. | 248/500 X |

FOREIGN PATENT DOCUMENTS

| | | | |
|---|---|---|---|
| 2927204 | 1/1981 | Fed. Rep. of Germany | 248/500 |
| 467959 | 6/1937 | United Kingdom | 248/680 |

*Primary Examiner*—Karen J. Chotkowski

*Attorney, Agent, or Firm*—Hill, Steadman & Simpson

[57] ABSTRACT

A floor anchor for a cabinet, particularly for a tool or parts cabinet in a shop or factory, itself anchored to the floor or other superstructure, and providing angularly bent prongs which engage the cabinet by overlying a floor portion of a back end of fork lift channels of the cabinet, the floor portion slid under the prongs. The floor anchor holds a backside of the cabinet down, preventing tipping forwardly of the cabinet when the weight of open drawers cause an overturning condition. The floor anchor also provides a securing strap which prevents the cabinet from becoming disengaged by preventing the cabinet from sliding forwardly with the floor portion retracting out from under the prongs of the floor anchor. The floor anchor provides a system of anchoring tool or parts cabinets which can be quickly disengaged from the anchor for removal and relocation elsewhere in the shop.

19 Claims, 1 Drawing Sheet

FLOOR ANCHOR FOR A CABINET

BACKGROUND OF THE INVENTION

This invention relates to an anchor plate for use with cabinets to prevent overturning of the cabinets caused by an overhanging weight of opened drawers. In particular, the invention relates to tool or parts cabinets, in a factory setting, which can be accidentally overturned if an excessive number of drawers holding heavy parts are opened simultaneously.

Tool or parts cabinets can be bolted to a floor surface to prevent overturning. However, such bolting is time consuming and makes frequent relocation of cabinets economically prohibitive. Additionally, anchoring cabinets by such arduous means can lead to inadvertent omission of the bolting step which can lead thereafter to overturning of the cabinet.

SUMMARY OF THE INVENTION

The present invention provides an anchor plate Which is bolted to a floor surface and which engages, with a plurality of prongs mounted thereon, a recessed portion of a tool cabinet. The prongs prevent lifting of a back of the tool cabinet, to prevent the cabinet from tipping forwardly.

In a factory or shop setting, tool and part cabinets can be moved around by the use of a fork lift truck. Commercial tool cabinets can be outfitted with channels, typically covered in use by an aesthetically pleasing cover plate, the channels receiving the two tines of a fork lift truck for lifting the cabinet and relocating it. The anchor plate, once bolted to the floor, or other superstructure, provides the two prongs formed therewith which are slightly elevated from the floor surface. The tool cabinet can be slid toward the anchor plate with the two prongs slidingly interfitting into the backside of the fork lift channels, overlying a floor portion of the channels. Once in this position, the backside of the cabinet cannot be lifted from the floor surface, thus tipping is prohibited. To prevent the cabinet from being dislodged from the prongs, a tie bar or strap is provided which secures the base plate to the cabinet by use of one screw.

The present invention provides a quickly installed anchor plate for anchoring a tool cabinet to a floor surface. Once the anchor plate is installed, a cabinet properly slid in place will be automatically anchored against overturning. Additional bolting steps are not required, although a tie bar or strap can be utilized if desired. Once installed, tool cabinets can be quickly disengaged and reengaged to the anchor plate. Unlike bolting an equipment cabinet directly to the floor, such disengagement can be quickly accomplished by the removal of merely one screw from the tie bar, wherein the cabinet can be slid out from under the prongs of the anchor plate.

DETAILED DESCRIPTION OF THE PREFERRED EMBODIMENTS

Figure 1:
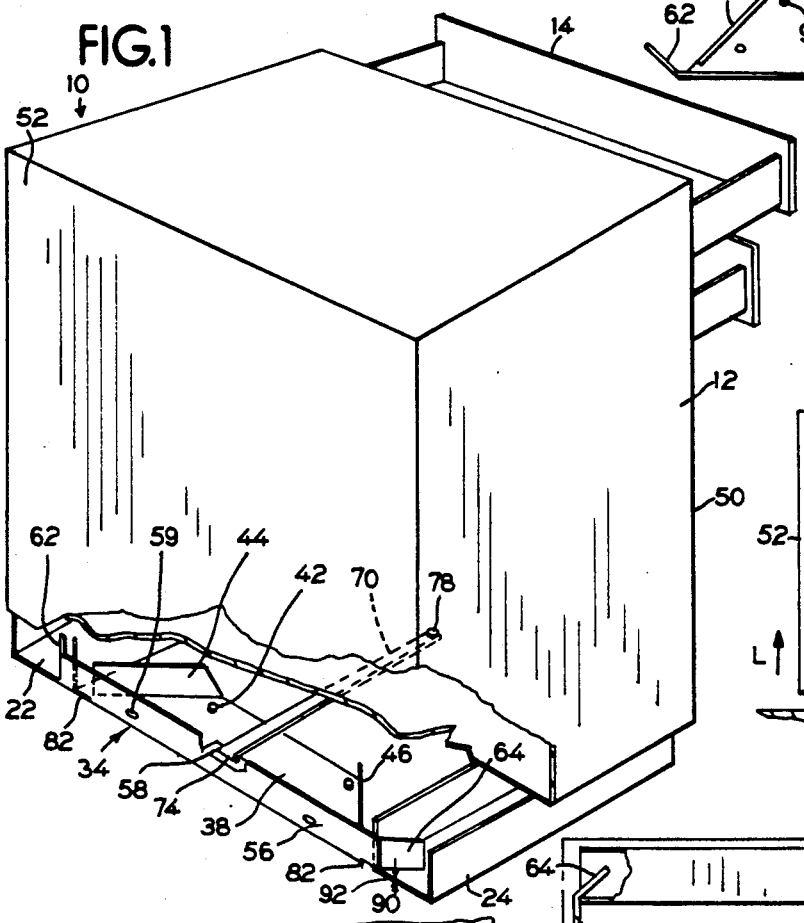
FIG. 1 is a fragmentary perspective view of a tool cabinet with some of the cabinetry removed for clarity.

FIG. shows a tool cabinet generally at 10 comprising outside panels 12, drawers 14, shown in the open position, and fork lift channels 22, 24. Also shown is a floor anchor assembly 34 which is the subject of the present invention.

The floor anchor assembly 34 comprises a base plate portion 38 which is bolted to a floor with a plurality of bolts 42. The floor anchor assembly further comprises side walls 44, 46 which provide rigidity to the base plate 38. The side walls 44, 46 are angled toward each other, toward a front 50 of the tool cabinet 10. Thus, the floor anchor forms a narrow profile toward the front 50, widening toward a back 52 of the tool cabinet 10. The floor anchor assembly 34 also comprises a back wall 56 which provides a center lug 58. The back wall 56 further provides side holes 59 wherein the floor anchor assembly can be secured to a wall structure which resides behind the tool cabinet 10. These side holes 59 provide an alternate location or an additional location to anchor the floor anchor assembly to the superstructure of the shop. A first prong 62, and a second prong 64 are formed with the back wall 56 on opposite ends thereof. The prongs 62, 64 extend outwardly of the base plate 38 and are angularly bent off from the back wall 56 toward the front 50 of the cabinet 10.

The floor anchor assembly 34 also provides a strap 70 having a hook 72 (shown in FIG. 6) which engages a slot 74 formed through the lug 58. The strap 70 proceeds from the lug 58 toward the front of the cabinet 10 where it is secured by a screw 78 to an underside 80 of the cabinet 10 (shown in FIG. 6).

The prongs 62, 64 are raised slightly off the floor surface providing a clearance 82 at least as great as a thickness 90 of a floor portion 92 of the fork lift channels 22, 24. This permits the fork lift channels 22, 24 to be slid along the floor 88 surface under the prongs 62, 64.

Figure 2:
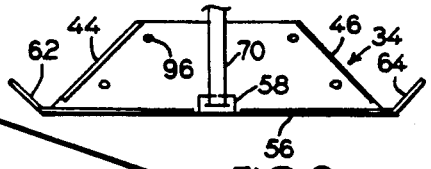
FIG. 2 is a partial plan view of the floor anchor plate.
Figure 5:
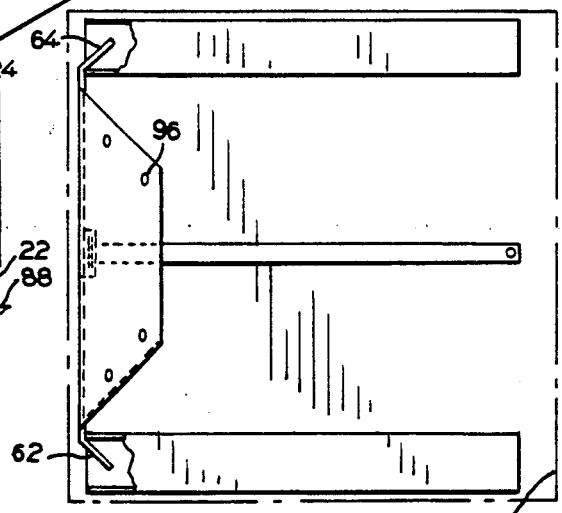
FIG. 5 is a bottom view of the tool cabinet of FIG. 1.

FIG. 2 and FIG. 5 shows that the base plate portion 38 provides a plurality of bolt holes 96 for anchoring the base plate portion 38 to the floor surface 88. The floor anchor assembly 34 is shown being tapered toward the front 50, which prevents interference of the side walls 44, 46 with the fork lift channels 22, 24 and helps to guide and align the prongs 62, 64 into the channels 22, 24 during sliding of the cabinet 10 over the base plate portion 38.

Figure 3:
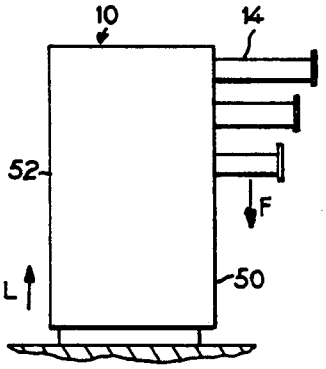
FIG. 3 is a side view of the tool cabinet of FIG. 1.

FIG. 3 simply demonstrates that an overhanging weight F of the open drawer 14 results in a lifting L at the back 52 of the tool cabinet 10 which can cause overturning of the cabinet 10 and possible property damage or injury at the front of the tool cabinet.

Figure 4:
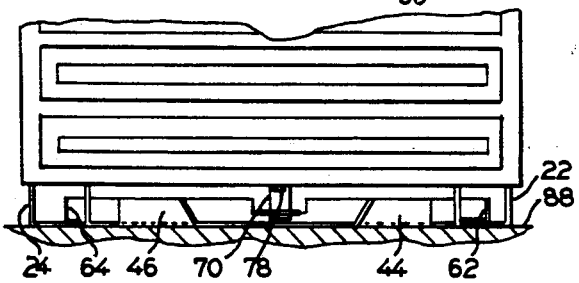
FIG. 4 is a partial front elevational view of the tool cabinet of FIG. 1.

FIG. 4 shows the tool cabinet installed onto the floor anchor assembly 34 with a front cover plate not installed, such that the fork lift channels 22, 24 can be seen.

Figure 6:
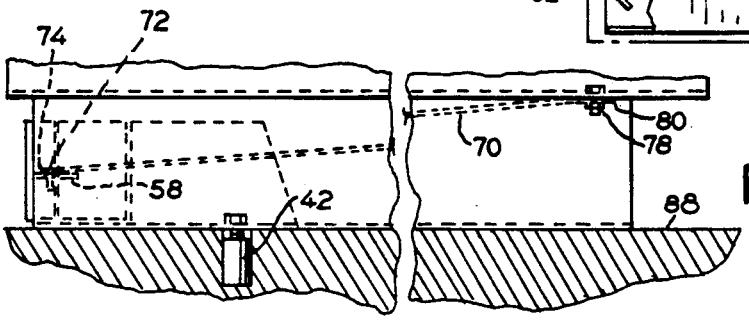
FIG. 6 is an enlarged partial side view of the tool cabinet of FIG. 1.

FIG. 6 shows the anchor bolts 42 set into the floor surface 88. When used in a typical factory or shop, the shop floor is concrete and the anchor bolts can be cinch-type anchor bolts embedded in the concrete. The anchor bolts can also be embedded in the concrete when the concrete floor is first poured. The strap 70 is shown hooked into the lug 58 through the slot 74.

It is clear from the figures that the floor anchor assembly 34 provides a rugged, quickly installed system for anchoring tool cabinets or other cabinets to a floor, and providing for a quick disengagement of the cabinets for relocation elsewhere in the shop. the particular shape of the floor anchor assembly can be modified and reconfigured without departing from the scope of the invention.

Although the present invention has been described with reference to a specific embodiment, those of skill in the art will recognize that changes may b made thereto without departing from the scope and spirit of the invention as set forth in the appended claims.

I claim as my invention:

1. A floor anchor assembly for securing a cabinet to a grade comprising:

a cabinet having a floor portion at a back end of the cabinet;

a base plate secured to grade;

a first prong and a second prong each mounted to said base plate and arranged to provide a clearance between a bottom of said prongs and grade and said base plate shaped so said cabinet si slidable over said base plate with said floor portion slidable beneath said prongs, said prongs overlying said floor portion, preventing said floor portion from lifting;

a back wall mounted to said base plate and extending a width of said base plate and terminating laterally outwardly of said base plate in said first prong at one end and in said second prong at an opposite end, said prongs turned angularly toward a front of said cabinet; and wherein said floor portion comprises bottom portions of a back end of laterally arranged fork lift channels for receiving the tines of a fork lift.

2. A floor anchor assembly for securing a cabinet to a grade comprising:

a cabinet having a floor portion at a back end of the cabinet;

a base plate secured to grade;

a first prong and a second prong each mounted to said base plate and arranged to provide a clearance between a bottom of said prongs and grade and said base plate shaped so said cabinet si slidable over said base plate with said floor portion slidable beneath said prongs, said prongs overlying said floor portion, preventing said floor portion from lifting;

a back wall mounted to said base plate and extending a width of said base plate and terminating laterally outwardly of said base plate in said first prong at one end and in said second prong at an opposite end, said prongs turned angularly toward a front of said cabinet, wherein said back wall comprises a lug; and an anchor strap mounted to said lug and secured to a front side of said cabinet.

3. A floor anchor assembly for securing a cabinet to a grade comprising:

a cabinet having a floor portion at a back end of the cabinet;

a base plate secured to grade;

a first prong and a second prong each mounted to said base plate and arranged to provide a clearance between a bottom of said prongs and grade and said base plate shaped so said cabinet si slidable over said base plate with said floor portion slidable beneath said prongs, said prongs overlying said floor portion, preventing said floor portion from lifting;

a back wall mounted to said base plate and extending a width of said base plate and terminating laterally outwardly of said base plate in said first prong at one end and in said second prong at an opposite end, said prongs turned angularly toward a front of said cabinet, said prongs overlying said floor portion to prevent lifting of said back end of said cabinet, wherein said back wall comprises bolt holes therethrough for mounting said back wall to a vertically oriented surface.

4. For a cabinet which provides a floor portion at a back end of the cabinet, a floor anchor assembly for securing the cabinet to a flat grade comprising:

a base plate having a planar bottom surface;

means for securing said planar bottom surface flushly to said flat grade;

at least one prong mounted to said base plate and arranged to provide a clearance between a bottom of said prong and grade and said base plate shaped so said cabinet is slidable over said base plate with said floor portion slidable beneath said prong, said prong protruding forwardly from said base plate in cantilever fashion toward a front side of said cabinet, said prong overlying said floor portion, preventing said floor portion from lifting;

wherein said base plate comprises formed side flanges for increasing rigidity of said base plate and arranged angled toward each other toward a front of said cabinet to align and guide said cabinet when said floor portion is slid under said prong.

5. A floor anchor assembly for securing a cabinet to a grade comprising:

a cabinet providing at its bottom laterally arranged fork lift channels for receiving tines of a fork lift, the fork lift channels providing a floor portion;

a base plate secured to grade, having a back wall mounted thereon, said back wall extending a width of said base plate and terminating laterally outwardly in a first prong and a second prong;

said first prong and said second prong arranged to provide a clearance between a bottom of said first prong and said second prong and grade, and said base plate shaped so said cabinet is slidable over said base plate with said floor portion slidable beneath said first prong and said second prong, said first prong and second prong turned angularly toward a front of said cabinet, said first prong and second prong overlying said floor portion to prevent lifting of said back end of said cabinet; and an anchor strap mounted to said base plate and secured to a front side of said cabinet.

6. A floor anchor assembly according to claim 5, wherein said base plate, said back wall, and said first and second prongs are arranged to be formed of one folded metal plate.

7. A floor anchor assembly according to claim 5, wherein said back wall comprises bolt holes therethrough for mounting said back wall to a vertically oriented surface.

8. A floor anchor assembly according to claim 5, wherein said base plate further comprises formed side flanges for increasing rigidity of said base plate and arranged angled toward each other toward a front of said cabinet to align and guide said cabinet when said floor portion is slide under said prongs.

9. A floor anchor assembly according to claim 8, wherein said base plate, said side flanges, said back wall, and said first and second prongs are arranged to be formed of one folded metal plate.

10. For a cabinet which provides at its bottom laterally arranged for lift channels for receiving the tines of a fork lift, the fork lift channels providing a floor portion, a floor anchor assembly for securing the cabinet to a grade comprising:

a base plate secured to said grade, having a back wall mounted thereon, said back wall extending a width of said base plate and terminating laterally outwardly in a first prong and a second prong;

said first prong and said second prong arranged to provide a clearance between a bottom of said first prong and said second prong and grade, and said base plate shaped so said cabinet is slidable over said base plate with said floor portion slidable beneath said first prong and said second prong, said first prong and second prong turned angularly toward a front of said cabinet, said first prong and second prong overlying said floor portion to prevent lifting of said back end of said cabinet;

wherein said base plate further comprises formed side flanges for increasing rigidity of said base plate and arranged angled toward each other toward a front of said cabinet to align and guide said cabinet when said floor portion is slid under said prongs; and a anchor strap mounted to said base plate and secured to a front side of said cabinet.

11. A floor anchor assembly according to claim 10, wherein said base plate, said side flanges, said back wall, and said first and second prongs are arranged to be formed of one folded metal plate.

12. A floor anchor assembly for securing a cabinet to a grade comprising:

a cabinet having a floor portion at a back end of the cabinet;

a base plate secured to grade;

at least one prong mounted to said base plate and arranged to provide a clearance between a bottom of said prong and grade and said base plate shaped so said cabinet is slidable over said base plate with said floor portion slidable beneath said prong, said prong overlying said floor portion, preventing said floor portion from lifting; and wherein said base plate further comprises formed side flanges for increasing rigidity of said base plate and arranged angled toward each other toward a front of said cabinet to align and guide said cabinet when said floor portions slid under said prong.

13. For a cabinet which provides flat floor panel portions at a back end of said cabinet for supporting said cabinet flushly on a flat grade, a floor anchor assembly for securing the cabinet to said flat grade comprising:

a base plate having a flat bottom surface adapted to be flushly secured to said grade;

a first prong and a second prong each connected to said base plate in cantilever fashion, extending laterally from said base plate and turned forwardly toward a front side of said cabinet, said prongs arranged to overhang grade to provide a vertical clearance between a bottom of said prongs and said grade and said base plate shaped to provide clearance on opposite lateral sides of each of said prongs so said cabinet is slidable over said base plate with said floor panel portions slidable beneath said prongs, said prongs overlying said floor panel portions preventing said floor panel portions from lifting from grade;

a back wall mounted to said base plate and extending a width of said base plate and extending laterally outwardly of said base plate to form said first prong at one end and said second prong at an opposite end, said prongs turned angularly toward said front side of said cabinet; and wherein said back wall further comprises a lug; and said assembly further comprises an anchor strap mounted to said lug and adapted to be secured to said front side of said cabinet.

14. For a cabinet which provides flat floor panel portions at a back end of said cabinet for supporting said cabinet flushly on a flat grade, a floor anchor assembly for securing the cabinet to said flat grade comprising:

a base plate having a flat bottom surface adapted to be flushly secured to said grade;

a first prong and a second prong each connected to said base plate in cantilever fashion, extending laterally from said base plate and turned forwardly toward a front side of said cabinet, said prongs arranged to overhang grade to provide a vertical clearance between a bottom of said prongs and said grade and said base plate shaped to provide clearance on opposite lateral sides of each of said prongs so said cabinet is slidable over said base plate with said floor panel portions slidable beneath said prongs, said prongs overlying said floor panel portions preventing said floor panel from lifting from grade;

a back wall mounted to said base plate and extending a width of said base plate and extending laterally outwardly of said base plate to form said first prong at one end and said second prong at an opposite end, said prongs turned angularly toward said front side of said cabinet; and wherein said back wall comprises bolt holes therethrough for mounting said back wall to a vertically oriented surface.

15. For a cabinet which provides flat floor panel portions at a back end of said cabinet for supporting said cabinet flushly on a flat grade, a floor anchor assembly for securing the cabinet to said flat grade comprising:

a base plate having a flat bottom surface adapted to be flushly secured to said grade;

a first prong and a second prong each connected to said base plate in cantilever fashion, extending laterally from said base plate and turned forwardly toward a front side of said cabinet, said prongs arranged to overhang grade to provide a vertical clearance between a bottom of said prongs and said grade and said base plate shaped to provide clearance on opposite lateral sides of each of said prongs so said cabinet is slidable over said base plate with said floor panel portions slidable beneath said prongs, said prongs overlying said floor panel portions preventing said floor panel portions from lifting from grade;

a back wall mounted to said base plate and extending a width of said base plate and extending laterally outwardly of said base plate to form said first prong at one end and said second prong at an opposite end, said prongs turned angularly toward said front side of said cabinet; and wherein said base plate further comprises formed side flanges for increasing rigidity of said base plate and arranged angled toward each other toward said front side of said cabinet to align and guide said cabinet when said floor panel portions are slid under said prongs.

16. For a cabinet which provides at its bottom laterally arranged fork lift channels for receiving the tines of a fork lift, the fork lift channels providing flat floor panels for supporting said cabinet flushly on a flat grade, a floor anchor assembly for securing the cabinet to said grade comprising:

a base plate having a flat bottom surface adapted to be flushly secured to said grade, having a back wall mounted thereon, said back wall extending a width of said base plate and extending laterally outwardly in cantilever fashion in a first prong and a second prong; and said first prong and said second prong arranged to provide a clearance between a bottom of said first prong and said grade and a bottom of said second prong and said grade, and said base plate shaped so said cabinet is slidable over said base plate with said floor panels slidable beneath said firsts prong and said second prong, said first prong and said second prong turned angularly toward a front side of said cabinet, said first prong and said second prong overlying said floor panels to prevent lifting of back side of said cabinet; and wherein said back wall comprises bolt holes therethrough for mounting said back wall to a vertically oriented surface.

17. For a cabinet which provides at its bottom laterally arranged fork lift channels for receiving the tines of a fork lift, the fork lift channels providing flat floor panels for supporting said cabinet flushly on a flat grade, a floor anchor assembly for securing the cabinet to said grade comprising:

a base plate having a flat bottom surface adapted to be flushly secured to said grade, having a back wall mounted thereon, said back wall extending a width of said base plate and extending laterally outwardly in cantilever fashion in a first prong and a second prong; and said first prong and said second prong arranged to provide a clearance between a bottom of said first prong and said grade and a bottom of said second prong and said grade, and said base plate shaped so said cabinet is slidable over said base plate with said floor panels slidable beneath said firsts prong and said second prong, said first prong and said second prong turned angularly toward a front side of said cabinet, said first prong and said second prong overlying said floor panels to prevent lifting of back side of said cabinet; and an anchor strap mounted to said base plate at a first end and securable at a second end to said cabinet.

18. For a cabinet which provides at its bottom laterally arranged fork lift channels for receiving the tines of a fork lift, the fork lift channels providing flat floor panels for supporting said cabinet flushly on a flat grade, a floor anchor assembly for securing the cabinet to said grade comprising:

a base plate having a flat bottom surface adapted to be flushly secured to said grade, having a back wall mounted thereon, said back wall extending a width of said base plate and extending laterally outwardly in cantilever fashion in a first prong and a second prong; and said first prong and said second prong arranged to provide a clearance between a bottom of said first prong and said grade and a bottom of said second prong and said grade, and said base plate shaped so said cabinet is slidable over said base plate with said floor panels slidable beneath said firsts prong and said second prong, said first prong and said second prong turned angularly toward a front side of said cabinet, said first prong and said second prong overlying said floor panels to prevent lifting of back side of said cabinet; and wherein said base plate further comprises formed side flanges for increasing rigidity of said base plate and arranged angled toward each other toward a front of said cabinet to align and guide said cabinet when said floor portion is slid under said prongs.

19. A floor anchor assembly according to claim 18, wherein said base plate, said side flanges, said back wall, and said first and second prongs are arranged to be formed of one folded metal plate.

* * * * *